US005751126A

United States Patent [19]

Hellinger et al.

[11] Patent Number: 5,751,126

[45] Date of Patent: May 12, 1998

[54] LIFTING APPLIANCE WITH TRAVELING MECHANISM AND LOW PENDULUM OSCILLATION DURING BRAKING

[75] Inventors: Frank Hellinger, Künzelsau, Germany; Ari Vaisanen, Hyvinkä , Finland

[73] Assignee: R. Stahl Fördertechnik GmbH, Germany

[21] Appl. No.: 619,422

[22] Filed: Mar. 21, 1996

[30] Foreign Application Priority Data

Mar. 24, 1995 [DE] Germany ..... 195 10 786.1

[51] Int. Cl.[6] ..... B66B 1/26; B66B 1/32; B66C 13/06; B66C 13/30

[52] U.S. Cl. ..... 318/362; 318/369; 187/292; 187/293; 187/295

[58] Field of Search ..... 318/362–379; 187/29, 276, 288, 287, 351, 289, 292, 293, 294, 295, 296, 297

[56] References Cited

U.S. PATENT DOCUMENTS

| | | | |
|---|---|---|---|
| 3,687,236 | 8/1972 | Caputo | 187/29 |
| 4,034,856 | 7/1977 | Wehrli et al. | 187/29 R |
| 4,042,069 | 8/1977 | Ohira et al. | 187/29 R |
| 4,046,229 | 9/1977 | Kernick et al. | 187/29 R |
| 4,102,436 | 7/1978 | Kernick et al. | 187/29 R |
| 4,278,150 | 7/1981 | Wehrli et al. | 187/29 R |
| 4,436,185 | 3/1984 | Ludwig et al. | 187/29 R |
| 4,503,939 | 3/1985 | Lawrence et al. | 187/29 R |
| 4,719,994 | 1/1988 | Kajiyama | 187/113 |
| 4,776,434 | 10/1988 | Caputo | 187/118 |
| 4,974,703 | 12/1990 | Nomura | 187/108 |
| 5,083,634 | 1/1992 | Yonemoto | 187/109 |
| 5,233,139 | 8/1993 | Hofmann | 187/133 |
| 5,402,863 | 4/1995 | Okumura et al. | 187/288 |

FOREIGN PATENT DOCUMENTS

| | | |
|---|---|---|
| 1218954 | 6/1966 | Germany . |
| 1241077 | 5/1967 | Germany . |
| 1273155 | 7/1968 | Germany . |

*Primary Examiner*—Paul Ip
*Attorney, Agent, or Firm*—Nilles & Nilles, S.C.

[57] ABSTRACT

An electric drive for the vehicle or traveling mechanism of a lifting appliance contains a control which controls the switching on of the mechanical brake and the switching of the motor current off and on again. In this case, there is provision, in the event of a changeover from a high traveling speed to slow maneuvering speed, for the mechanical brake to remain released until the maneuvering speed is approached. During this phase, the vehicle is decelerated solely by the internal friction and the rolling friction on the rail, in order to avoid inducing any or any additional load pendulum oscillation.

15 Claims, 2 Drawing Sheets

LIFTING APPLIANCE WITH TRAVELING MECHANISM AND LOW PENDULUM OSCILLATION DURING BRAKING

BACKGROUND OF THE INVENTION

Starting and/or acceleration of traveling mechanisms of lifting appliances sets the load suspended on the rope or chain in pendulum oscillation, thus making it considerably more difficult to manoeuver the load and also constituting a hazard. Even when it has been possible to suppress the load pendulum oscillation induced by starting over the travelling distance, renewed load pendulum oscillation may be triggered during braking from a high traveling speed to a slow or maneuvering speed. Since this changeover from the high traveling speed to the low maneuvering speed generally occurs shortly before the destination, the load pendulum oscillation is still in full swing when the destination is reached. A further aggravating circumstance is that a greater speed jump occurs during the transition from high speed to low speed than during stopping from low speed. The changeover from high speed to low speed is therefore an event which contributes to the load pendulum oscillation to a greater extent that the subsequent stopping operation.

In addition to the problem of load pendulum oscillation, induced by the changeover to low speed, there is a problem of regulation when motors having a flat speed/torque characteristic are used for driving the traveling mechanism, in other words motors, in which the rotational speed depends greatly on the load. Such motors require a regulating device, and, under certain circumstances, this may be excited as a result of the load pendulum oscillation after the engine current has been switched on again for operation at low speed. The consequence of this is that, on account of the load which leads the traveling mechanism, the regulation possibly attempts to cut back the engine speed too sharply. After the changeover, a stalling of the traveling speed would thereby be brought about.

OBJECT AND SUMMARY OF THE INVENTION

Proceeding from this, the object of the invention is to provide an electric drive for vehicles or traveling mechanisms of lifting appliances, in which the pendulum oscillation of the load after the changeover from high speed to low speed is reduced.

According the invention, during the changeover from high speed to low speed the brake is already being actuated again for the purpose of opening, even before the low speed is actually reached, whilst, on the other hand, the current supply for the motor simultaneously remains switched off. This measure ensures two things at the same time. Firstly, the sharpness of the transition from the deceleration phase to the traveling phase at low speed is markedly flattened out. In other words, sharp jolt-like changes in the current traveling speed are avoided. Secondly, there is a possibility of converting the load pendulum oscillation induced by braking into propulsive energy of the traveling mechanism and thus of damping the pendulum energy, provided, of course, that the phase relationship is appropriate. Even if the second possibility is out of the question because the phase relationship is unfavorable, however, at least no additional jolt adversely intensifying the pendulum oscillation is produced.

Load pendulum oscillation capable of being induced by braking can further be avoided if, during the changeover to low speed, the brake is not activated immediately, but only after a predetermined delay time, whilst, on the other hand, the current supply to the motor is switched off immediately.

The deceleration of the traveling mechanism takes place initially only as a result of the rolling friction of the traveling mechanism on the rail, so that the transition to the state with an activated or applied brake is made with a less sharply pronounced wrench.

An advantageous regulating characteristic is obtained if the current supply is switched on again only when the low speed is reached or overstepped. The current supply to the motor is then preferably switched on at an amplitude mean or a frequency which is lower than that necessary for travel at the low speed. Such a mode of operation is beneficial when, on account of the phase relationship of the pendulum oscillation, the load endeavors to drag the traveling mechanism.

A particularly simple drive is obtained if the motor is a universal series motor and the current regulating device for this contains a phase control. It is thereby possible to achieve a freewheel characteristic which, in terms of pendulum damping, acts in exactly the same way as a freewheel in the drive train.

Moreover, developments of the invention are the subject of subclaims.

BRIEF DESCRIPTION OF THE DRAWINGS

An exemplary embodiment of the subject of the invention is represented in the drawing. In this.

DETAILED DESCRIPTION OF THE PREFERRED EMBODIMENTS

Figure 1:
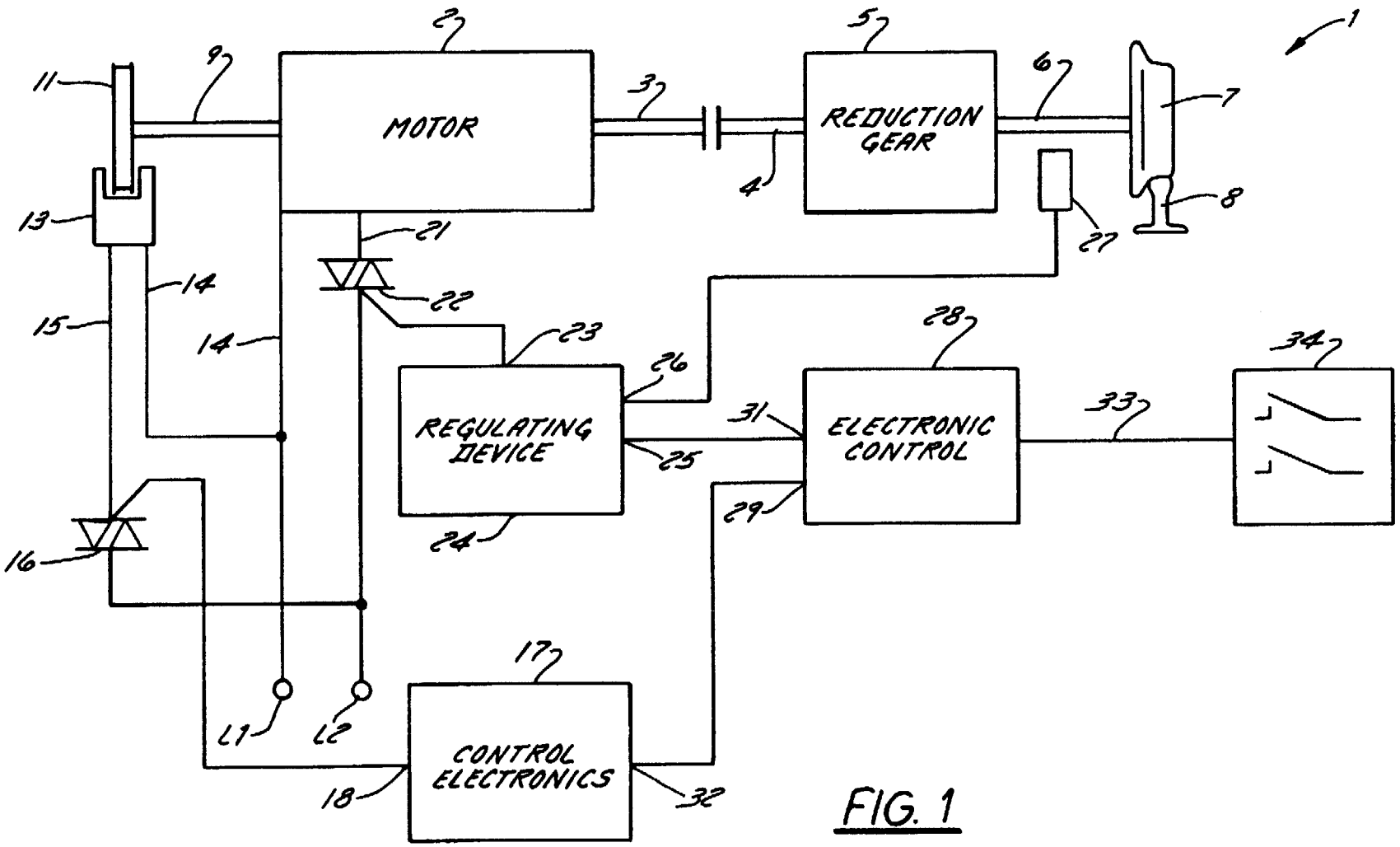
FIG. 1 shows a block representation of the electric drive according to the invention.

FIG. 1 illustrate highly diagrammatically an electric drive 1 for vehicles or traveling mechanisms of lifting appliances capable of suspending loads therefrom by a chain or rope. In this case, the individual electric and mechanical subassemblies are illustrated as functional blocks, so that the essence of the invention can be seen more clearly.

The electric drive 1 has a motor 2 in the form of a universal motor with an armature shaft 3, in said universal motor the armature and field being connected electrically in series. The motor 2 consequently has a series characteristic. Such a motor has no upper speed limit, beyond which it could act as a generator and therefore as a brake, provided that the polarity between the armature and the field is not changed.

The armature shaft 3 of the motor 2 is coupled fixedly in terms of rotation to an input shaft 4 of a reduction gear 5, onto the output shaft 6 of which one of the wheels 7 of the traveling mechanism is placed likewise fixedly in terms of rotation, said wheel running on a traveling rail B.

The shaft 3 of the motor 2 also projects on the other side and there forms a shaft stub 9, on which a brake disk 11 is arranged. The brake disk cooperates with a diagrammatically shown braking and actuating device 13. The brake actuating device 13 is applied by means of springs not shown further, with the result that brake members (not shown) come to bear on the brake disk 11 and slow down the latter or brake it to a standstill. By means of an electromagnet, the braking device 13 can be opened counter to the effect of the springs, in order to allow the brake disk 11 to run freely.

The braking device 13 has two electric junction leads 14 and 15, of which the junction lead 14 is directly connected to a network conductor L1 of a two-phase alternating voltage network, the other phase conductor of which is designated by L2.

The other junction lead 15 of the magnet of the braking device 13 is connected via a triac 16 or a relay or the like to the other phase conductor L2 of the network. The triac 16 receives a control signal at its gate from control electronics 17, to the output 18 of which the gate is connected.

The motor 2 is likewise connected in a bipolar manner via two leads 19, 21 to the two phase conductors L1 and L2, a further triac 22 being arranged in the junction lead 21 leading to the phase conductor L2. The gate of said triac 22 is connected to an output 23 of a regulating device 24 which serves, in the case of a corresponding signal at an input 25, to control the triac 22 in such a way that the motor 2 runs at a low or a high rotational speed and the motor 2 is stabilized at this rotational speed. For this purpose, a rotational speed sensor 27 which, for example, senses the output shaft 6 is connected to a further input 26 and transmits an electric signal proportional to the rotational speed of the wheel 7. Because the circumference of the wheel 7 is known, the signal transmitted by the sensor 27 also represents the traveling speed of the traveling mechanism.

In order to control both the regulating device 24 and the control circuit 17, an electronic control 28 preferably based on a microprocessor and having two outputs 29 and 31 is provided. The output 31 is connected to the input 25, whilst the output 29 leads to an input 32 of the control circuit 17. Depending on the embodiment, the rotational speed sensor 27 can also be connected additionally to the electronic control 28.

The electronic control 28 is itself connected on the input side, via a multiwire connection 33, to a switch arrangement 34, via which said electronic control receives its command signals. The switch arrangement 34 either can be directly a mechanical switch arrangement, which is accommodated, for example, in a control bulb of the lifting appliance, or it represents signal states which, in the case of an automatically controlled lifting appliance, pass from a master control into the electronic control 28.

In contrast to what is represented, it is also possible to implement the regulating device 24 on the same microprocessor, by means of which the electronic control device 28 is also implemented.

Since the present control is involved essentially with braking, it is assumed, to make it easier to understand the functional description, that only three signal commands can be transmitted to the electronic control 28 by means of the switch arrangement 34. In the first state, none of the switches is actuated. This corresponds to the neutral position of the switches. The second state corresponds to travel at low speed and is designated by "D" in the flow diagram, described below, according to FIG. 2. The third state corresponds to travel at maximum speed and is denoted by "F" in the flow diagram of FIG. 2.

Figure 2:
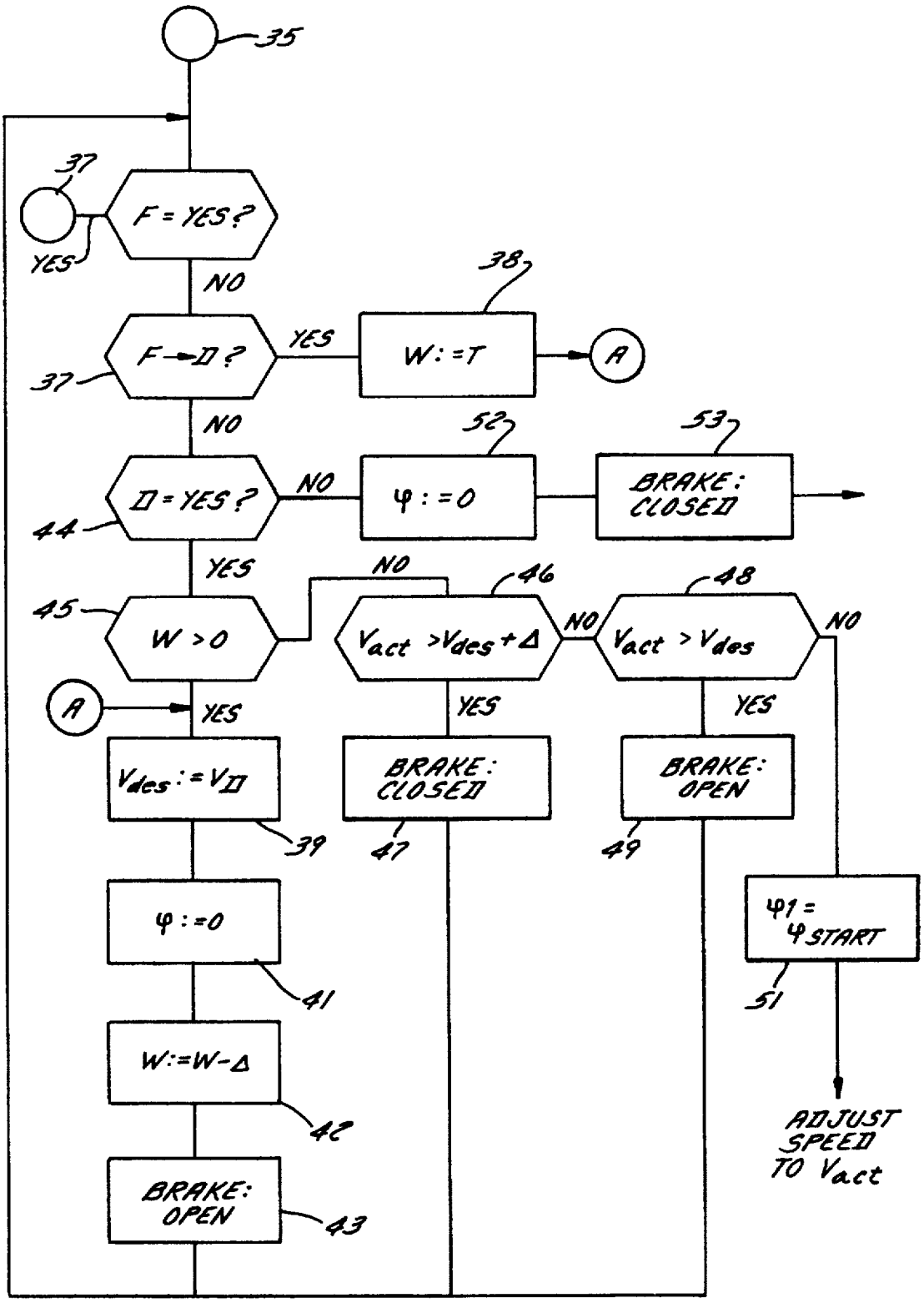
FIG. 2 shows a flow diagram for the actuation of the brake or of the current regulating device of the drive according to FIG. 1.

The working mode and functioning of the electric drive are now explained below with the aid of the flow diagram of FIG. 2:

If the user has not actuated any of the switches of the switch arrangement 34, neither the state "D" nor the state "F" is present, thus causing the electronic control to stop the regulating device 24 and to hold it in the stop state, so that it does not transmit any ignition pulses to the triac 22. The current supply to the motor 2 is thereby interrupted. At the same time, the control circuit 17 likewise receives no corresponding signal from the electronic control 28, as a result of which the triac 16 also remains in the blocked state. The braking device 13 is consequently applied and brakes the brake disk 11 to a standstill, with the result that the entire traveling mechanism is slowed down and cannot be moved.

When, proceeding from this operating situation, the user actuates the switches of the switch arrangement 34 in such a way that the state "F" is switched on, this meaning that the vehicle or traveling mechanism is to run at its maximum speed, the electronic control 28 releases the regulating device 24 and simultaneously transmits to it a reference value for the rotational speed of the output shaft 6 which is to be reached and held. The regulating device 24 then begins to transmit trigger pulses synchronized with the alternating voltage of the network to the output 23, with the result that the triac 22 is periodically ignited. The relative position of the trigger pulse in relation to the voltage crossover of the network oscillation defines the angle of current flow $\phi$ and consequently the mean of the flowing current, on which the rotational speed of the motor 2 is in turn dependent. The angle of current flow is adjusted by the regulating device 24 in such a way that the gear output shaft 6 and the wheel 7 run at the predetermined rotational speed, specifically irrespective of the load. Simultaneously with the outputting of trigger pulses to the triac 22, the control circuit 17 also receives a corresponding release signal at its input 32, as a result of which it too begins, at its output 18, to supply trigger pulses to the triac 16. The current through the brake lifting magnet is thereby switched on and the braking device 13 is lifted counter to the effect of the prestressing device, so that the brake disk 11 and consequently also the motor 2 can run freely and in an unimpeded manner.

The mode of starting is described in detail in the older patent application P 45 . . . . to which reference is made here.

When the vehicle or traveling mechanism together with the lifting appliance approaches its destination, the user will change over from the high traveling speed to the low traveling speed, in order to move into the destination position at slow speed, so that he assumes the destination position as accurately as at all possible. As long as the state "F" was present, the program in the electronic control continually entered, at 35, the program segment shown in FIG. 2 and, at a branch point 36, checked whether the state "F" was present. Since, by definition, this traveling state was switched on, the check was correct each time, with the result that the program was left again immediately at 37 and entered other program parts which perform other control tasks. After these control tasks have been worked through, the program is in each case returned periodically to the point 35 again. The times up to reappearance at the point 35 are necessarily less than 10 ms on account of synchronization with the network frequency.

As soon as, as assumed, the user changed over from the state "F" to the state "D", the enquiry condition at the branch point 36 was no longer satisfied, and therefore the program was switched further to a branch 37. A check is made at this point as to whether the state "D" is present and whether the state "F" present during the last program pass has been present. When the condition is satisfied, the program proceeds in an instruction block 38, in which a timer is set to a predetermined waiting time. In practice, this waiting time is preferably between 0 and 350 ms, but can also amount to 700 ms. After the time has been set, the program proceeds directly to an instruction block 39. Here, the reference value $V_{des}$ for the speed, to which the regulating device 24 is to adjust the rotational speed of the motor 2, is set equal to that rotational speed $V_D$ which corresponds to travel at low speed.

As explained, the user switched back from high traveling speed to low traveling speed, which means that the traveling mechanism must slow down. In order to achieve this, the angle of current flow $\phi$ for the triac 22 is set at zero in an instruction block 41, which means that, in the next network halfwave, the triac 22 receives no trigger pulse and remains blocked. The timer variable w is reduced by a predetermined $\Delta$ in an instruction block 42, in order to obtain the desired stopwatch function.

In an instruction block 43 which is then reached, the electronic control 28 gives the control circuit 17 the command to transmit an ignition pulse to the triac 16, so that, as in the previous traveling mode, the brake remains opened. To make the explanation simpler, it is assumed that no other program parts are run through, and therefore, after the instruction block 43, the program returns network-synchronously to the input upstream of the branch point 36.

Because the user wishes, as before, to travel further at the slow speed, the state D persists, that is to say the enquiry at the branch point 36 causes the program to run further to the branch point 37. Since the branch point 37 is now already run through for the second time or the state contained in the previous pass was no longer F, but D, the timer variable w is no longer reset in the block 38, but remains at its value updated in the block 42 and, instead, the program passes via the instruction block 38 to a branch point 44, at which a check is made as to whether the state D is present. If this is so, an enquiry is made at a subsequent branch point 45 as to whether the time variable w for the stopwatch function is still greater than zero and, if so, the program then comes to the instruction block 39 which, during the previous pass, was reached from the instruction block 38. After the instruction block 39 and the subsequent instruction blocks 41, 42 and 43 have been worked through, the program returns to the input upstream of the branch point 36 (it will be assumed, for the sake of simplicity, that no other program parts which have anything to do with the invention are run through between leaving the block 43 and returning to the branch point 36).

In the third pass which then follows, the program behaves in the same way as in the previous pass. This behavior persists until the time variable counted back incrementally in the instruction block 42 has become zero or less than zero. The program will then transfer, at the branch point 45, to a branch point 46, because, although the condition that the state "D" is present is still satisfied, nevertheless the time variable has in the meantime become less than zero.

As is evident, up to the expiry of the time function, the control circuit 17 received the command to continue to transmit trigger pulses to the triac 16 so that the braking device 13 remains opened.

After the expiry of the stopwatch function, brought about by means of the variable w, a check is made at the branch point 46 as to whether the actual speed is higher than the reference speed $V_{des}$ plus a predetermined value $\Delta$. This value $\Delta$, converted into the rotational speed of the motor 2, corresponds approximately to 500 revolutions per minute.

Since, until the branch point 46 was reached for the first time, the traveling mechanism was braked only by the rolling friction and the losses in the gear 5, when the branch point 46 is reached for the first time the actual speed will still be higher than the desired speed plus $\Delta$. The program therefore goes to the instruction block 47. At this point, the electronic control 28 gives the control circuit 17 the command not to transmit any trigger pulse to the triac 16, so that the brake lifting magnet begins to deenergize and the brake can no longer be kept opened counter to the effect of the spring.

After the instruction block 47, the program returns once more to the input upstream of the branch 36. The pass just described from the branch point 36 to the instruction block 47 is run through very many times, which, on the one hand, means that, during the passes, the braking device 13 is actually applied at some time and slows down the brake disk 11 appreciably, so that a marked deceleration of the traveling mechanism occurs. The speed of the traveling mechanism will consequently decrease very rapidly and, after one of the passes, the condition $V_{act}>V_{des}+\Delta$ will no longer be satisfied. The program therefore no longer goes to the instruction block 47, but to the branch point 48, and checks whether the actual speed has in the meantime fallen below the desired speed. If this is not so, at an instruction block 49 the program again instructs the control circuit 17 in future to transmit trigger pulses for the triac 16. The brake lifting magnet is thereby energized and the corresponding brake members are lifted off from the brake disk 11, as a result of which the braking effect on the brake disk 11 disappears. This disappearance of the braking effect will take place even over a plurality of program passes on account of the finite response time of the braking device 13. Practical values for the response time of the brake are around approximately 100 ms, which, at an assumed network frequency of 50 Hz, corresponds to ten program passes.

Consequently, this means that the brake is lifted again even before the low speed is reached. The vehicle or traveling mechanism will therefore not change with the deceleration to the low speed, which corresponds to the applied brake, but with a deceleration which corresponds to the rolling friction of the traveling mechanism on the rail 8, plus the mechanical losses contained in the traveling drive. For this purpose, at the branch point 48, the program changes over to the instruction block 49 until it is established by means of the sensor 27 that the low speed has fallen below the limit value. From this moment, the program leaves the branch point 48 via the instruction block 51, at which the angle of current flow $\phi$ is set to a permanently predetermined value different from zero. This permanently predetermined value is lower than that angle of current flow which, on the basis of empirical tests, is necessary for the traveling mechanism to travel at the low desired speed.

Moreover, a variable, the checking of which is not represented in the program shown, is set in such a way that the program shown in FIG. 2 is run through again only when either the state "D" disappears and also the state "F" is not present, or when the state "D" returns after the changeover to the state "F".

For the sake of completeness, the behavior of the program will also be explained in respect of the situation that the user wishes to stop directly from high speed, that is to say neither the state "F" nor the state "D" is present any longer. Under these circumstances, at the branch point 44 the program goes to an instruction block 52 which ensures that the angle of current flow $\phi$ is set to zero, corresponding to the triac 22 being kept blocked. Subsequently, at an instruction block 53, the control circuit 17 is immediately induced to interrupt the transmission of trigger pulses to its triac 16, so that the brake can be applied.

The electric drive described can also be modified to the effect that, after the change from "F" to "D", there is a transfer to the enquiry 46 immediately after the enquiry 44 and the instruction block 47 is followed by the instruction blocks 39 and 41 described.

The advantage of the time sequence described is that, at least at the end of the braking phase, there is a switch back to slight deceleration, with the result that the transition from braking to traveling at a constant speed is less jolt-like. Because each jolt causes a pendulum movement of the suspended load, with reduced jolting the pendulum movement is also correspondingly slighter. Finally, the arrangement has the advantage that braking with the brake applied is followed by a freewheel phase which corresponds to an opened brake, but a currentless motor 2, thus affording the possibility of using pendulum energy to propel the traveling mechanism, in order thereby to damp the pendulum oscillation, provided, of course, that a favorable phase relationship of the pendulum oscillation occurs at the point of changeover to the freewheel mode.

Switching on the triac 22 again with a relatively large angle of current flow $\phi$ prevents an unnecessary stalling of the traveling speed, which occurs when an integral action controller is present in the regulating device 24 for stabilizing the traveling speed. These integral action controllers have a relatively high time constant and, without the changeover to the predetermined phase angle, too long a time would be needed before the integral action controller generates an angle of current flow for the triac 22 at which sufficiently propulsive energy can come from the motor 2. In contrast, if the angle of current flow $\phi$, at which the regulation of the motor 2 is switched on again, were larger than the angle of current flow which is necessary in order to run the motor 2 at a speed higher than the desired slow speed, the braking distance would be lengthened needlessly, thus making it unnecessarily difficult for the user to position the traveling mechanism. The system reacts, as it were, sluggishly to the traveling commands given by the driver.

An electric drive for the vehicle or traveling mechanism of a lifting appliance contains a control which controls the switching on of the mechanical brake and the switching of the motor current off and on again. In this case, there is provision, in the event of a changeover from the rapid speed to the slow maneuvering speed, for the mechanical brake to remain released until the maneuvering speed is approached. During this phase, the vehicle or traveling mechanism is decelerated solely by the internal friction and the rolling friction on the rail, in order to avoid inducing any or any additional load pendulum oscillation.

We claim:

1. An electric drive for a vehicle of a lifting appliance, said vehicle having wheels, said electric drive comprising:

a motor which is operatively coupled to at least one wheel of the vehicle, at least one brake which is assigned to one of the wheels and which is switched to and fro via electrical signals between an engaged state and a disengaged state, a signal generator arrangement having first, second, and third states, of which the first corresponds to the stopping of the vehicle, the second corresponds to traveling at a low speed, and the third corresponds to traveling at a high speed, an electronic control to which the signal generator arrangement is connected and which actuates 1) an electrically controllable switch, located in a current lead to the motor, and 2) a brake actuator, and a speed transmitter which supplies the electronic control with information on the speed of the vehicle, wherein the electronic control is automatically operable, upon a change of the state of the signal generator arrangement from the third state to the second state, to 1) switch the current supply to the motor off and 2) to control the brake actuator to initially permit the brake to remain disengaged and to subsequently engage the brake only when the speed of the vehicle becomes lower than a reference speed corresponding to a speed which is higher than the low speed.

2. The electric drive as claimed in claim 1, wherein, in the event of a changeover from the third state to the second state, the electronic control is operable to control the brake for the purpose of application without additional deceleration.

3. The electric drive as claimed in claim 1, wherein, in the event of a changeover from the third state to the second state, the electronic control device is operable to control the brake for the purpose of application with additional deceleration.

4. The electric drive as claimed in claim 1, wherein the electronic control is operable to supply the motor with current again only after the low speed is reached.

5. The electric drive as claimed in claim 1, wherein, when the motor is switched on again, the electronic control is operable to supply the motor with a current which, has a mean or a frequency which is lower than that necessary for traveling at the low speed.

6. The electric drive as claimed in claim 1, wherein the motor is assigned a motor current regulating device which is connected to the speed transmitter and via which the motor current can be controlled in terms of amplitude or frequency for the purpose of keeping a predetermined motor speed constant.

7. The electric drive as claimed in claim 6, wherein the motor current regulating device has first and second states, and wherein the motor current regulating device, in the first state, controls the motor current in terms of amplitude or frequency for the purpose of keeping the low speed constant and, in the second state, controls the motor current in terms of amplitude or frequency for the purpose of keeping the high speed constant.

8. The electric drive as claimed in claim 6, wherein the motor current regulating device is changed over into the state of stabilization of the low speed only when the low speed is reached or fallen below.

9. The electric drive as claimed in claim 1, wherein the motor has a freewheel characteristic.

10. The electric drive as claimed in claim 1, wherein a freewheel is contained between the motor and the wheel driven by the motor.

11. The electric drive as claimed in claim 1, wherein the motor is a motor having the characteristic of a universal series motor.

12. The electric drive as claimed in claim 6, wherein the motor current regulating device contains a phase control.

13. The electric drive as claimed in claim 1, wherein the brake is a mechanical brake.

14. A lifting appliance comprising (A) a vehicle capable of supporting a load therefrom by a chain or rope, said vehicle including at least one wheel; and (B) an electric drive including (1) an electric motor which is operatively coupled to said wheel, (2) a brake coupled to said wheel, (3) an electronically-controlled brake actuator coupled to said brake and operable to switch said brake between an engaged state and a disengaged state, (4) a signal generator arrangement having a first state which corresponds to the stopping of said vehicle, a second state which corresponds to travel of said vehicle at a relatively low, maneuvering speed, and a third state which corresponds to travel of said vehicle at a relatively high, traveling speed, (5) electronic control means, operatively coupled to said signal generator, said motor, and said brake actuator, for controlling operation of said motor and said brake actuator, wherein, when said signal generator is switched from the third state to the second state, said electronic control means 1) switches off a current supply to said motor to cause the traveling speed of said vehicle to fall from the high speed to the low speed and 2) controls said brake actuator so that, as the traveling speed of said vehicle falls from the high speed to the low speed, said brake is initially disengaged and then is engaged when the speed of said vehicle falls below a reference speed which is higher than the low speed but lower than the high speed.

15. A method of reducing load pendulum oscillation comprising:

(A) supplying current to an electric motor to drive a vehicle to move at a relatively high, traveling speed, wherein said vehicle is capable of supporting a load therefrom by a chain or rope and includes at least one wheel which receives motive power from said electric motor and which is braked by a brake, wherein current to said electric motor and current to an electronic actuator for said brake are supplied by an electronic control which is coupled to a signal generator arrangement, and wherein said signal generator arrangement has a first state which corresponds to the stopping of said vehicle, a second state which corresponds to travel of said vehicle at a relatively low, maneuvering speed, and a third state which corresponds to travel of said vehicle at the traveling speed, (B) switching said signal generator arrangement from the third state to the second state; and (C) in response to the switching of said signal generator arrangement from said third state to said second state, automatically operating said electronic control to reduce the speed of said vehicle from the high speed to the low speed by (1) switching off the current supply to said motor, and (2) controlling said brake actuator so that, as the traveling speed of said vehicle falls from the high speed to the low speed, said brake is initially disengaged and then is engaged when the speed of said vehicle falls below a reference speed which is higher than the low speed but lower than the high speed.

* * * * *